US005904058A

United States Patent [19]

Barnes

[11] Patent Number: 5,904,058

[45] Date of Patent: May 18, 1999

[54] DECAMBERER

[76] Inventor: Austen Barnes, 3407 Holborn Road, RR2 Queensville, Ontario, Canada, LOG 1R0

[21] Appl. No.: 08/839,399

[22] Filed: Apr. 11, 1997

[51] Int. Cl.[6] ..... B21B 37/00

[52] U.S. Cl. ..... 72/11.1; 72/8.3; 72/240; 72/241.6

[58] Field of Search ..... 72/8.3, 8.9, 9.1, 72/9.4, 10.4, 11.1, 11.6, 11.7, 12.7, 234, 237, 241.4, 241.6, 252.5, 10.1, 13.3, 13.4, 240, 248, 203, 204, 14.4, 14.5

[56] References Cited

U.S. PATENT DOCUMENTS

| | | | |
|---|---|---|---|
| 1,860,931 | 5/1932 | Keller | 72/241.4 |
| 4,651,547 | 3/1987 | Murel et al. | 72/241.6 |
| 5,209,095 | 5/1993 | Kimura et al. | 72/241.4 |
| 5,655,398 | 8/1997 | Ginzburg | 72/241.4 |

FOREIGN PATENT DOCUMENTS

| | | | |
|---|---|---|---|
| 62-21411 | 1/1987 | Japan | 72/9.1 |
| 63-90309 | 4/1988 | Japan | 72/9.1 |
| 1-31511 | 2/1989 | Japan | 72/9.1 |
| 4-224005 | 8/1992 | Japan | 72/241.4 |
| 62-77719 | 10/1994 | Japan | 72/8.3 |

*Primary Examiner*—Joseph J. Hail, III
*Assistant Examiner*—Ed Tolan

[57] ABSTRACT

Camber of a travelling wide strip is provided by a pair of opposed rollers adapted to bear on opposite wide sides of such a strip. Mutually independent means are provided to provide deforming pressure at a selected end of said opposed rollers.

12 Claims, 3 Drawing Sheets

DECAMBERER

This invention relates to means and a method for reducing the camber of flat strip.

Flat metal strip is slit and usually coiled pending use. Camber, that is a lateral bending about an axis perpendicular to the strip is frequently produced in the course of slitting the strip and renders the strip difficult or impossible to use in stamping or forming operations.

It is therefore desirable and frequently necessary to remove the camber from such strip.

Method of the prior art of correcting the camber, is to bend the strip sideways by side contact rolls pressing on the convex edge of the cambered strip. However, although this can be effective with narrow thick strips, wide or thin strips buckle if side loads are imposed.

In another method of the prior art the material is bent sideways by flat rolling the upper and lower surfaces adjacent to the concave edge side, extending it to the same length as the formerly convex side. The processed strip is straight but has a slightly tapered cross section with the tapered edge on the formerly concave side.

Such former flat rolling type decamberers have operated on the criteria of controllable position actuated camber correction in order to try to achieve the exact rolling depth required to correct the camber. However this requires the precise precisioning of heavy rolls and is very costly as very precise large mechanisms are required.

In accord with this invention there is provided a flat rolling type decamberer having controlled pressure rather than controlled position because the use of controllable pressure is much less costly than the use of controllable position.

The controllable force is between the opposed rollers rolling on the opposed wide surfaces of the strip. However, in the preferred embodiment the opposed rollers are located below and above a strip in generally horizontal attitude, the lower roller is of fixed height and the pressure is applied downwardly by the upper roller.

In accord with a preferred aspect of the invention means are provided for controlling the pressures between corresponding ends of the upper and lower rollers and this is achieved by exerting pressure downward on one or the other end of the roller against the reaction of the lower roller. Thus, in the proposed mode of operation, the end of the upper roller on the convex side is either without or with minimal downward pressure. The end of the upper roller on the concave side is subject to the downward pressure which deforms the strip on a gradient deepest on the concave side by the amount calculated to correct the camber. This pressure is maintained until changed to improve the correction value. If a different pressure is then required to correct the camber, sensors and controls cooperate to converge toward the best correction values and repeat their activity when the camber changes.

It is preferred to use the equipment as just described in combination with pressure sensing and corrective means.

The correcting means described above may be simply a matter of sensing the camber in an upstream sensor and applying the concave roller end pressure to correct it. This is seldom practically feasible. Better results may be achieved by providing a sensor, downstream from the camber correction means, for sensing the camber at the downstream point and feeding back a correction to the concave side pressure controller. This should correct the camber with some delay in convergence or hunting of an elementary negative feed back system.

The preferred system is to combine upstream and downstream sensors with the pressure means.

The upstream sensor, (as qualified hereafter) is adapted to set the differential pressure to correct the camber, the sensor incorporating a gain factor between its detection and output stages. The downstream sensor senses the degree of camber uncorrected by the pressure means and feeds back a signal in a corrective sense to improve the camber correction. This may be combined in several ways with the influence of the upstream sensor to achieve a sensitive and rapidly converging result.

The preferred way of correcting the cambers successively detected by the upstream and downstream sensors is to control the concave side pressure in accord with the upstream sensor and to correct the gain of the control in accord with the camber sensed by the downstream. This produces a sensitive control and by proper parameters will produce a converging result. This requires adjustment with each type of strip processed, however the sensor settings may be stored for the next usage with such strip.

The preferred embodiment of the invention is schematically illustrated in the following drawings.

Figure 1:
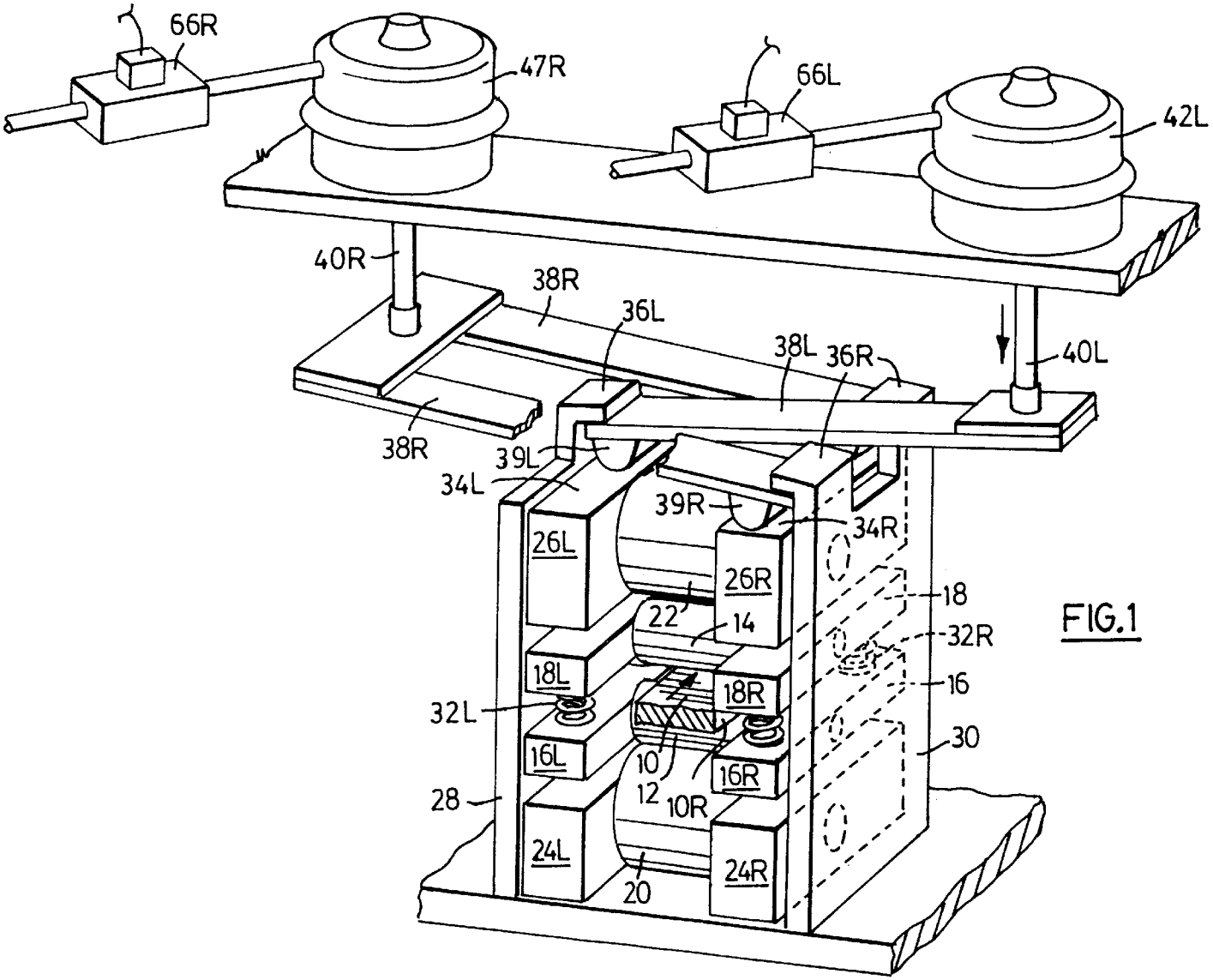
FIG. 1 shows a pneumatic device for strip concave side pressure to the roller ends.

In the drawings FIG. 1 shows a strip 10 rolling between a pair of opposed decambering rolls 12 and 14 typically made of tool steel whose bearings roll at each end in pairs of slide blocks 16L, 16R and 18L, 18R respectively.

To achieve the degree of deformation and work necessary to apply to the strip 10 to correct the camber it is often convenient to use hardened alloy steel backup rolls 20 and 22 whose bearings are mounted to roll at each end in pairs of slide blocks 24 and 26 respectively.

The pairs of blocks 16, 18, 24, 26 are free to slide up and down in the housing shell indicated by walls 28 and 30. (The front and rear shell guides which would keep the blocks from movement in these directions are omitted for clarity.)

Between each end of blocks 18L and 16L are forward and rearward compression springs 32L (the rearward one is not shown) and between each end of blocks 18R and 16R are forward and rearward compression springs 32R.

Compression springs 32L on the left side and compression springs 32R on the right side hold the respective blocks 16 and 18 apart when no loading is present, keeping rolls 12 and 14 apart when no loading is present to allow easy entry of strip 10.

Thus lower backup roll 20 is supported on blocks 24 from the machine base, although it may be adjustable in height for various strip thicknesses, by means not shown.

Backup roll 22 is supported on blocks 26L and 26R which are free to float vertically in the shell.

Backup roll 22 is fully in contact with decambering roll 14 at all times. Backup roll 20 is in contact with decambering roll 12 at all times.

Thus with the equipment so far described, a strip 10 (see also FIG. 3) which is concave to the left in the travel direction may be rendered less so by deformation of the strip on the left or concave side by creating a deforming pressure between the left ends of rollers 12 and 14 while the right ends may contact the strip but not deform it.

In the preferred embodiment such differential pressure is created pneumatically and the pneumatic pressure is applied with a mechanical advantage to the relevant backup roller to obtain the desired deforming pressure at one pair of the ends of decambering rolls 12 and 14.

In a preferred aspect the mechanical advantage is achieved by a leverage technique. Flange 36L acts as the fulcrum for a lever 38L whose anvil 39L exerts downward pressure on upper face 34L of block 26L. Lever 38L, remote from flange 36L, is subject to downward thrust from the actuating rod 40L operated for downward movement by bellows 42L. Rod 40L is actuated upward by return springs, not shown in bellows 42L.

Similarly two flanges 36R act with a lever 38R composed (for symmetry relative to the shafts (not shown) of rollers 22 and (14) of dual arms having anvils 39R with the lever 38R controlled for downward movement by actuating rod 40R from bellows 42R and for upward movement by return springs, not shown. Thus the force provided by a bellows 42 is magnified by the mechanical advantage of the lever 38 for application of deforming pressure to a decambering roll.

Figure 2:
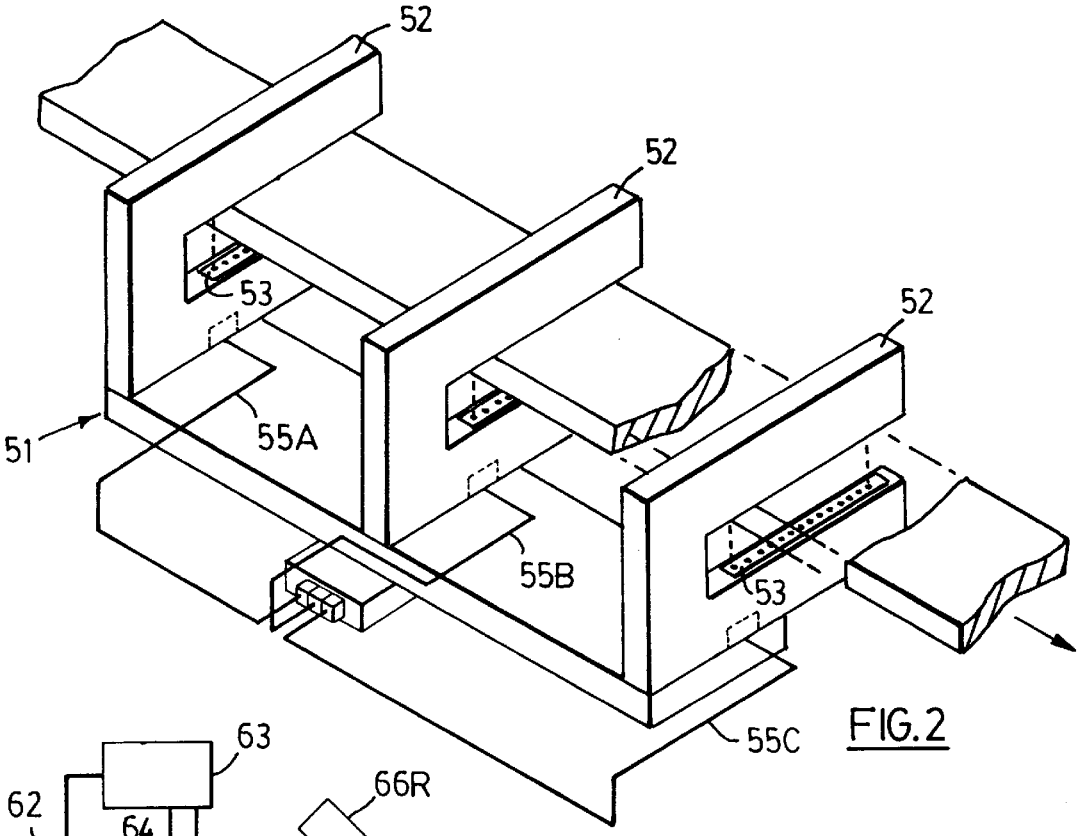
FIG. 2 shows a camber sensor.

The control for the bellows 42R or 42L will now be described. A sensor 51 for the strip camber is shown in FIG. 2. Three pairs of arms 52, are arranged along the strip 10. Each pair of arms 52 uses a plurality of laser scanners or fibre optics (hidden by the upper arm) and detectors 53 arranged transversely to the strip direction, and detectors 53 are connected to sense the point of passage of a strip edge here, the right edge 10R. With three such measurements relayed on Conductors 55A, 55B, 55C to a processor 54 may determine whether the camber is such that the strip is concave left, (as shown), straight, or concave right.

Figure 3:
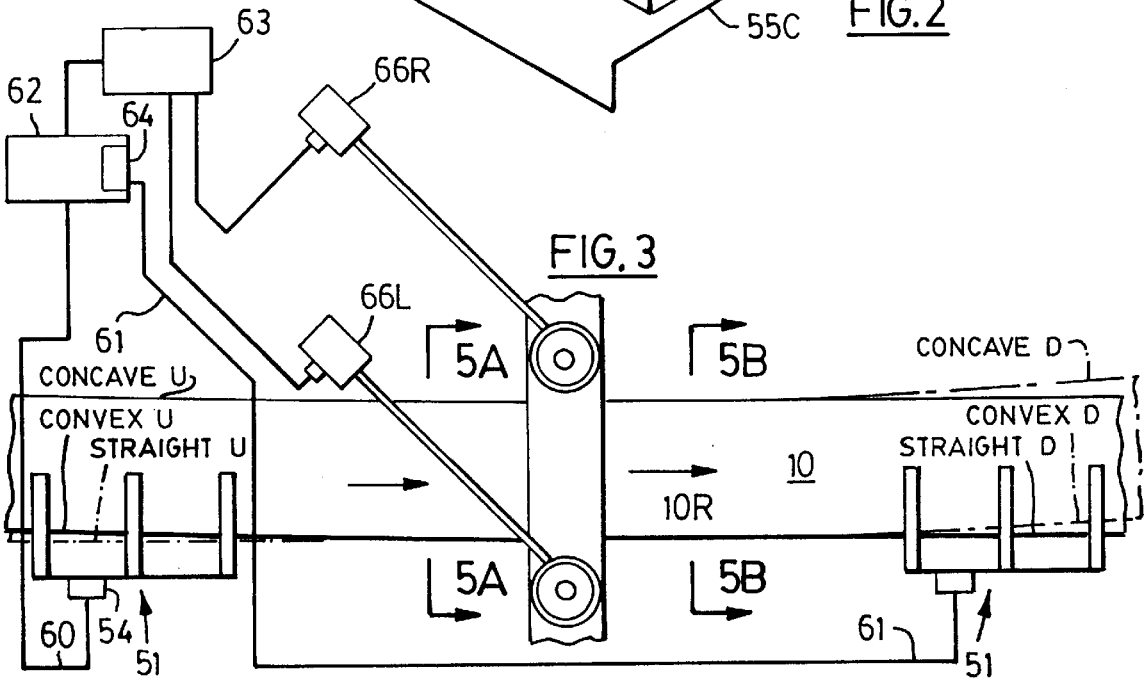
FIG. 3 shows a device of FIG. 1 combined with upstream and downstream sensors of the type in FIG. 2.

As shown in FIG. 3 a sensor 51 is located upstream and downstream from the decambering assembly.

The upstream sensor 51 calculates the camber of the strip entering the decambering device. The edges 51 labelled CONVEX U and CONCAVE U have shapes indicated in comparison with the straight datum STRAIGHT U shown dotted.

The camber measured at the upstream sensor 51 is supplied over conductor 60U to the amplifier 62 to the amplifier having gain control 64. The processor 63 supplies electrical signals, in accord with the electrical signals at its input to control the pneumatic pressure at pneumatic control 66R or 66L. The signals are provided to the bellows 42L through the lever, not shown to cause the pressure of anvil 39L to press on block 26L surface to alter the roller axis to lower the left hand end of roller axis of roller 22, to, in turn lower the left hand end of roller 14. The right hand pneumatic supply need not be used unless a small amount is used to limit vibration of the right hand ends of the roller.

The pressure at one end of roller 14 has been calculated by processor 63 to deform the strip over a gradient the camber. This pressure valve may be in error, or initially in error and subject to correction or updating. Accordingly, the result of this (and the downstream sensor 57 feedback to be discussed) is that the strip emerges from the decambering rolls 12–14 with the shape of the solid line STRAIGHT D instead of its original form shown in chain dot CONVEX-CONCAVE D.

Figure 5A:
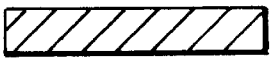
FIG. 5A and FIG. 5B show in magnified form a strip cross-section before and after treatment with the strip travelling into the plane of the paper.
Figure 5B:
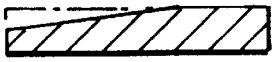

FIG. 5A in magnified form indicates the generally rectilinear shape of a strip before camber correction. FIG. 5B shows the strip after correction for a camber that is concave left and the chain dotting completes the contour of the strip before deformation.

The STRAIGHT D attitude may not be as straight as desired and is measured at the downstream sensor 51.

The camber measured at downstream sensor 51 is used to modify the result from the upstream sensor. There are a large number of ways this could be done, but I prefer to accomplish this result by using the measurement at the downstream sensor 51 to control the gain 64 of the upstream sensor signal to processor 63. Obviously, experimentation with the parameters implicit in elements 62, 63, 64 is required to achieve the correct scale of corrections provided by the sensors 51.

If the camber had been concave to the right, the process described above would have been reversed with the deforming pressure provided through the right hand bellows to apply the deforming pressure to the right hand end of roller 18R for the desired correction processed with the roles of the upstream and downstream sensors being as before.

As previously noted when the strip size is changed, the values for an earlier used strip size may be stored for use when needed.

Although the embodiment shown uses the mechanical magnifying levers in series with the pneumatic supply, it is within the scope of the invention to use another mechanical advantage lever or other device or to eliminate the mechanical advantage of the lever or other device and use a proportionately higher pressure bellows applying the deforming pressure through block 26L or 26R to the end of a decambering roller 14 on the desired side to deform the strip at the right or left hand end against the reaction of or roller 12.

Figure 4:
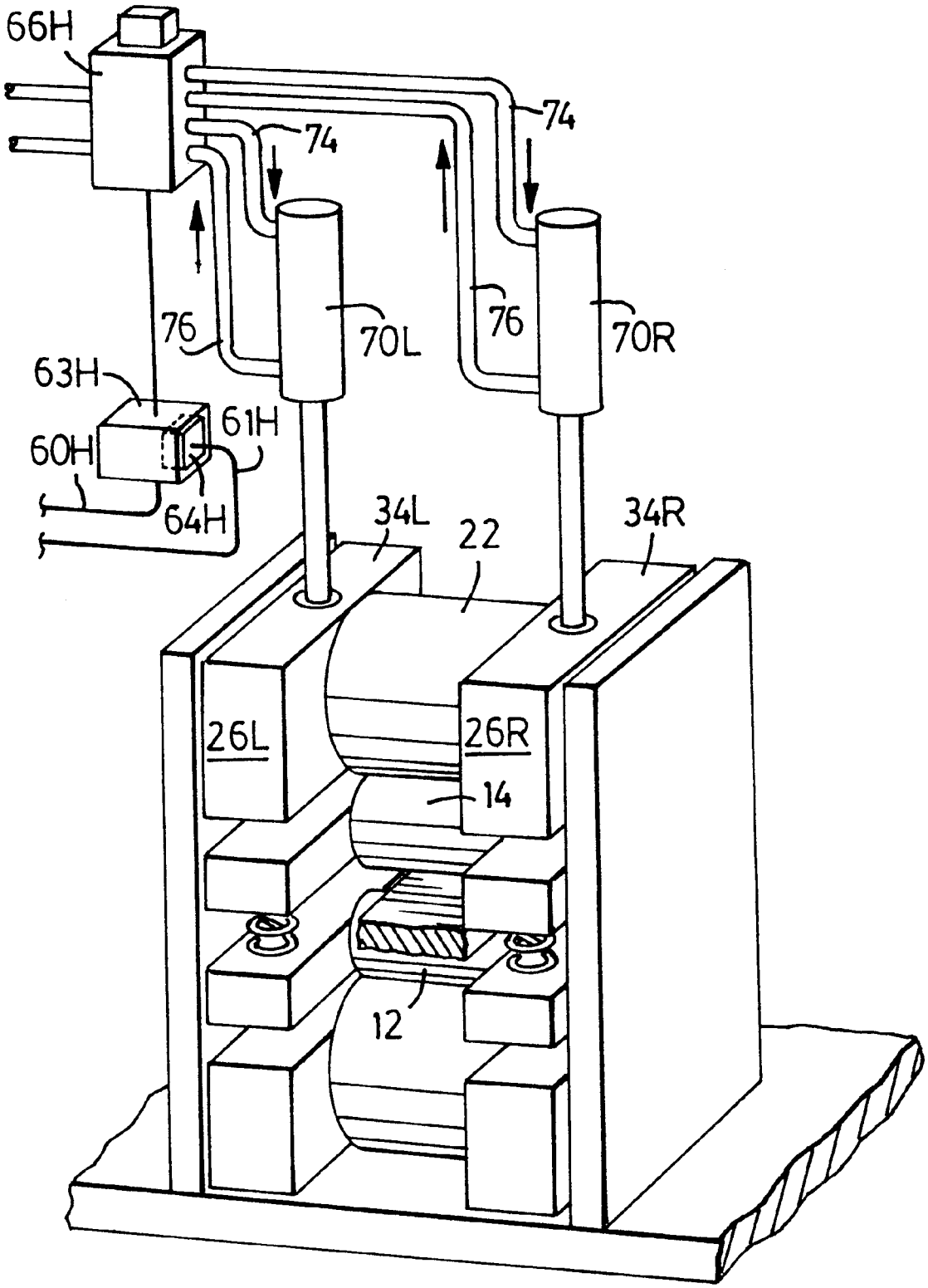
FIG. 4 shows an hydraulic device for operation in place of the device of FIG. 1.

FIG. 4 shows that hydraulic cylinders 70 may be used instead of pneumatic cylinders to create the deforming pressure between one of the corresponding ends of rollers 14 and 12.

With the assembly of FIG. 4 the upstream sensor 51 provides on line 60H a signal of the value of upstream camber to the input of amplifier 63H. The gain 64H of amplifier 63H is controlled by the signal on line 61H from the downstream sensor. The amplifier output is provided to processor and valve 66H which process the signal and applies the right degree of deforming pressure from cylinder 70L or 70B. The upstream and downstream sensors 51 may be used or combined with amplifier 63H as they were in the pneumatic alternative to provide a continually self correcting adjustment to the camber correction.

As previously noted either the pneumatic or hydraulic alternative may be used without the upstream sensor using elementary negative feedback for continuing control.

Either system can use only an upstream sensor but its ability to accurately correct camber is very limited.

I claim:

1. Means for correcting a camber of a travelling wide strip, including a pair of opposed rollers bearing on opposite wide sides of such strip, first linear rod actuated means for controlling a pressure of said rollers toward each other at one corresponding end of each roller, second linear rod actuated means for controlling the pressure of said rollers toward each other at the other corresponding end of each roller, means for independently controlling the pressure applied by said first linear rod actuating means and said second linear rod actuating means to provide deforming pressure from a selected one of said means, and means for determining the deforming pressure comprising: means for continually obtaining a measurement of the camber of said travelling strip, means for determining a force exerted by the linear rod actuating means corresponding to a concave side of said strip as determined by said camber measurement.

2. Means for correcting camber as claimed in claim 1 including means for controlling differences between the pressure applied by said first and second controlling means, thereby causing one of said first and second controlling means to apply a higher pressure and providing a pressure amount for the higher pressure means.

3. Means for correcting as claimed in claim 1 including means for controlling the force exerted by the linear rod actuating means corresponding to a convex side of said strip so that said strip is not substantially deformed on said concave side.

4. Means for correcting as claimed in claim 1 wherein said camber measurement obtaining means is located upstream from said rollers.

5. Means for correcting as claimed in claim 1 wherein first and second camber measurement obtaining means are located upstream and downstream from said rollers and the force exerted by the linear rod actuating means is determined by parameters determined in accord with each of said first and second operating means.

6. Means for correcting as claimed in claim 1 wherein the linear rod actuation is by pneumatic means.

7. Means for correcting as claimed in claim 5 wherein the linear rod actuation is by pneumatic means.

8. Method for altering a camber of a travelling strip with opposed wide sides, including the steps of:

providing a pair of opposed rollers located to bear on opposite sides of said strip, controlling a pressure applied at one end of one of said rollers through a first linear rod actuating means toward a corresponding end of the other of said rollers, controlling the pressure applied at the other end of the one of said rollers through a second linear rod actuating means toward the other end of the one of said rollers, maintaining the pressure applied at said one end of one of said rollers below that pressure sufficient to substantially deform said strip and maintaining the pressure applied at a second end sufficient to deform said strip, in accord with current camber determination, where said second end corresponds to a then concave side of said strip.

9. Method as claimed in claim 8 wherein said linear rod actuating means are pneumatic.

10. Method as claimed in claim 8 wherein camber determination is made upstream from said opposed rollers.

11. Method as claimed in claim 9 wherein camber determination is made upstream from said opposed rollers.

12. Method as claimed in claim 8 wherein camber determination is made upstream and downstream from said opposed rollers, and said downstream and upstream determinations are combined to present camber determination.

* * * * *

UNITED STATES PATENT AND TRADEMARK OFFICE

CERTIFICATE OF CORRECTION

PATENT NO. : 5,904,058

DATED : May 18, 1999

INVENTOR(S) : Austen Barnes

It is certified that error appears in the above-identified patent and that said Letters Patent is hereby corrected as shown below:

Claim 3 line 5 , change 'concave' to --convex--

Signed and Sealed this

Seventh Day of November, 2000

*Attest:*

*Attesting Officer*

Q. TODD DICKINSON

*Director of Patents and Trademarks*